United States Patent [19]

Frear et al.

[11] Patent Number: 4,869,690

[45] Date of Patent: Sep. 26, 1989

[54] CONTACT FOR CRIMP TERMINATION TO A TWINAXIAL CABLE

[75] Inventors: David L. Frear, Bainbridge; Valentine J. Hemmer, Unadilla, both of N.Y.

[73] Assignee: Amphenol Corporation, Wallingford, Conn.

[21] Appl. No.: 46,757

[22] Filed: May 7, 1987

[51] Int. Cl.[4] ..... H01R 17/18

[52] U.S. Cl. ..... 439/675; 439/585; 439/877

[58] Field of Search ..... 439/578–585, 439/675, 677, 99, 736, 98, 877, 881, 882

[56] References Cited

U.S. PATENT DOCUMENTS

| | | | |
|---|---|---|---|
| 3,148,011 | 9/1964 | Brown | 439/736 |
| 3,281,756 | 10/1966 | O'Keefe et al. | 439/99 |
| 4,033,662 | 7/1977 | Swiger | 439/736 |
| 4,307,926 | 12/1981 | Smith | 439/580 |
| 4,397,516 | 8/1983 | Koren et al. | 439/584 |
| 4,431,254 | 2/1984 | Cartesse | 439/675 |
| 4,572,605 | 2/1986 | Hess | 439/736 |

*Primary Examiner*—David Pirlot

*Attorney, Agent, or Firm*—Bacon & Thomas

[57] ABSTRACT

A contact for crimp termination to a twinaxial cable is disclosed. The contact includes an outer assembly and an intermediate/inner assembly concentrically disposed within the outer assembly. The intermediate/inner assembly includes a concentric arrangement of permanently affixed components for receiving the two conductors of the twinaxial cable, and for retaining said conductors to effect the termination.

10 Claims, 3 Drawing Sheets

CONTACT FOR CRIMP TERMINATION TO A TWINAXIAL CABLE

BACKGROUND OF THE INVENTION

Prior to the present invention pin and mating socket contacts for twin axial cables have included a plurality of non-integrated components, and terminating the cable to the contacts has been accomplished by soldering and the like.

Modern uses for twin axial cables such as, for example, in aerospace applications have placed increased emphasis on shielding electrical signals transmitted over these cables from electromagnetic interference. This is accomplished by shielding the cables, and an arrangement for terminating the shielded cables to the contacts is necessary. It is desirable that this arrangement be simple in structure and have as few loose components as possible.

The present invention is advantageous for the aforenoted purposes in that it enables simplified crimp termination to twinaxial cables, while having the advantageous feature of a minimal number of bonded or otherwise integral components.

SUMMARY OF THE INVENTION

This invention contemplates a contact for crimp termination to a twinaxial cable. The contact includes an outer contact assembly and an intermediate/inner contact assembly. The outer contact assembly includes an outer contact and a dielectric insulator concentrically affixed internal the outer contact. The intermediate/inner contact assembly includes an intermediate contact, a dielectric intermediate to inner insulator, an inner contact and a dielectric insulator concentrically affixed together. Upon terminating the contact to the twinaxial cable, the pair of conductors of the cable are simultaneously directed through apertures and bores in the intermediate/inner contact assembly. The bores are then crimped or deformed to retain and electrically join the contact to the conductors.

This invention discloses and claims a contact for termination to a twinaxial cable comprising outer contact means; intermediate/inner contact means disposed within the outer contact means; the intermediate-/inner contact means including first means for receiving first and second conductors of the twinaxial cable; second means for receiving one of the first and second conductors directed through the first means and third means for receiving the other of the first and second conductors directed through the first means; and the second and third means being deformable, whereby upon deformation thereof the first and second conductors are retained by said second and third means for terminating the contact to the cable.

DETAILED DESCRIPTION OF THE INVENTION

Figure 1:
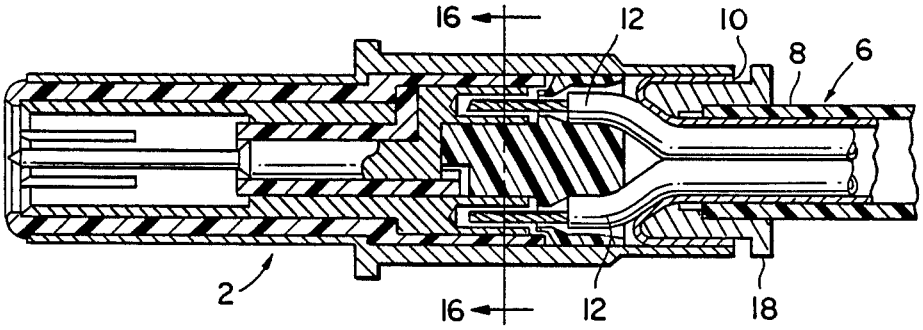
FIG. 1 is a longitudinal sectioned view of a wire twinaxial pin contact according to the invention.
Figure 2:
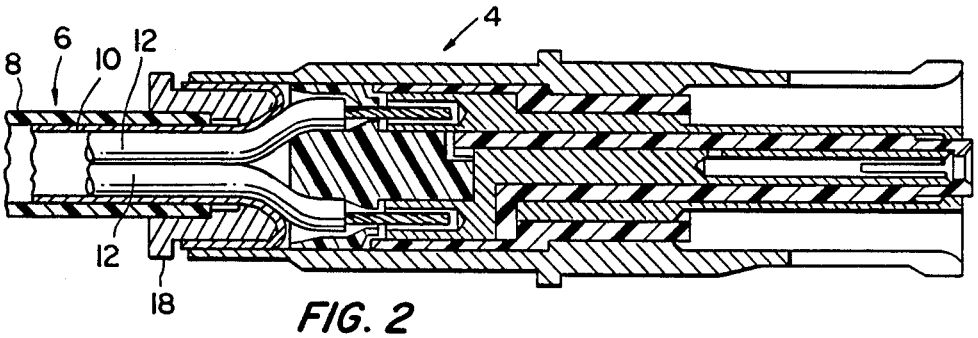
FIG. 2 is a longitudinal sectioned view of a wired twinaxial socket contact according to the invention.

A concentric twinaxial pin contact 2 is shown in FIG. 1 and a mating socket contact 4 is shown in FIG. 2. The contacts are crimp terminated to a twinaxial cable 6 including an insulating dielectric outer jacket 8 of Teflon or the like, a copper alloy braided shield conductor 10 and a pair of conductors 12 including Teflon insulation over stranded copper alloy conductors. It will be understood that the structural relationships of the several components to be herein described relate substantially to both the pin and socket contacts.

Figure 3:
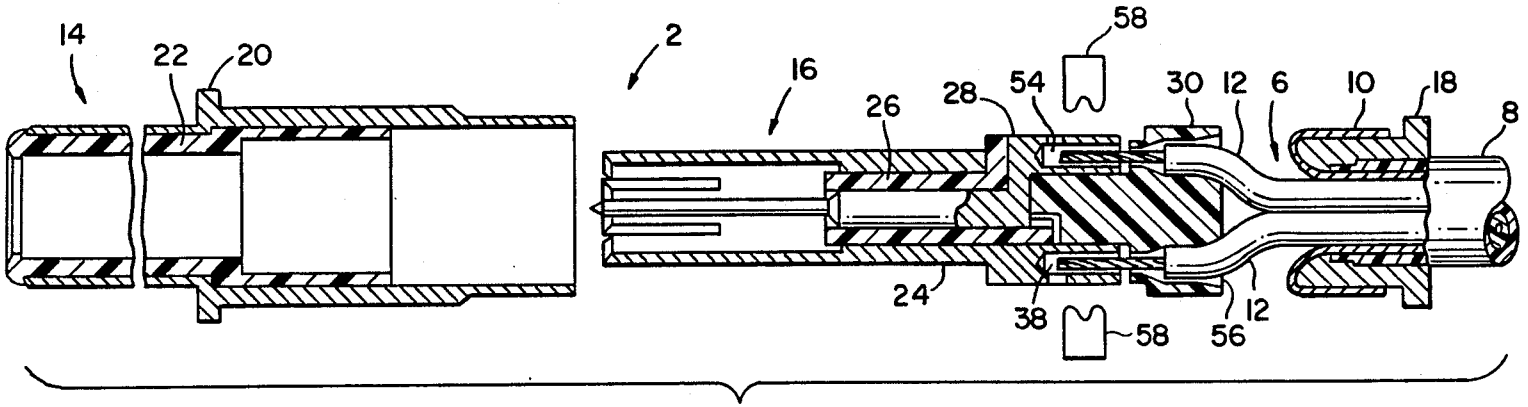
FIG. 3 is an exploded longitudinal sectioned view of a male twinaxial pin contact according to the invention.

With reference to FIG. 3, the arrangement contemplated includes an outer contact assembly 14, an intermediate/inner contact assembly 16 disposed in outer contact assembly 14 and a gold plated copper alloy crimped ferrule 18. Outer contact assembly 14 includes a gold plated copper alloy outer contact 20 and a dielectric insulator 22 of a rigid plastic such as polyamide-imide or polyetherimide, or the like disposed therein and permanently affixed thereto as by adhesive bonding or the like to the outer contact.

Intermediate/inner contact assembly 16 includes a gold plated intermediate contact 24, a dielectric intermediate to inner insulator 26 of a material such as that for insulator 22 disposed in contact 24, a gold plated copper alloy inner contact 28 disposed in insulator 26 and a dielectric insulator 30 of a material such as that for insulators 22 and 26 adjacent to contact 28. The several components of assembly 16 are likewise affixed to each other as by adhesive bonding or the like. It will now be understood that outer contact assembly 14 and intermediate/inner contact assembly 16 each include a plurality of concentrically arranged components as shown and described.

Figure 6:
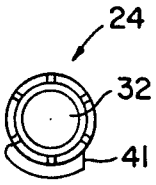
FIG. 6 is a left end view thereof.
Figure 4:
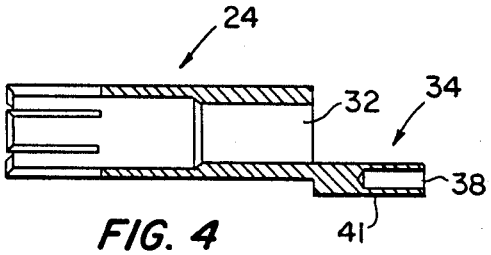
FIG. 4 is a longitudinal sectioned view of an intermediate contact according to the invention.
Figure 5:
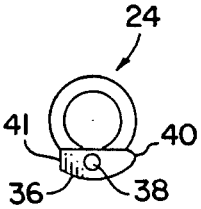
FIG. 5 is a right end view thereof.
Figure 13:
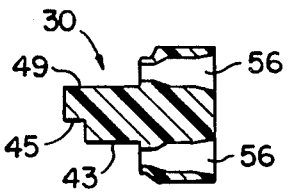
FIG. 13 is a longitudinal sectioned view of an insulator according to the invention.

With reference to FIGS. 4, 5 and 6, intermediate contact 24 includes an axial bore 32 which receives insulator 26, and an area 34 which includes a circular segment 36 having a deformable bore 38 for receiving one of the conductors 12 when cable termination occurs. A flattened area 40 of circular segment 36 adjoins a like flat area 43 of rear insulator 30 (FIG. 13). Intermediate contact 24 has a flat 41 best shown in FIGS. 4, 5 and 17.

Figure 9:
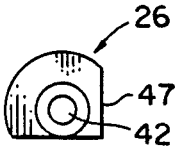
FIG. 9 is a left end view thereof.
Figure 7:
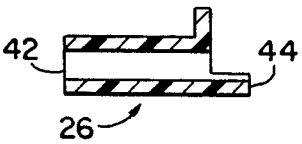
FIG. 7 is a longitudinal sectioned view of an intermediate to inner contact insulator according to the invention.
Figure 8:
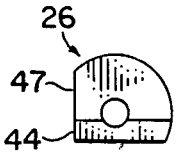
FIG. 8 is a right end view thereof.
Figure 15:
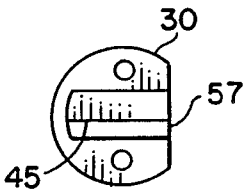
FIG. 15 is a left end view thereof.

With reference to FIGS. 7, 8 and 9, intermediate to inner insulator 26 has a bore 42 which receives inner contact 28. The insulator has a basically rectangular portion 44 which is aligned with a flat area 45 of insulator 30 (FIG. 15). Insulator 26 has a flat 47 best shown in FIGS. 8, 9 and 17.

Figure 11:
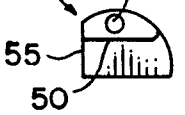
FIG. 11 is a right end view thereof.
Figure 10:
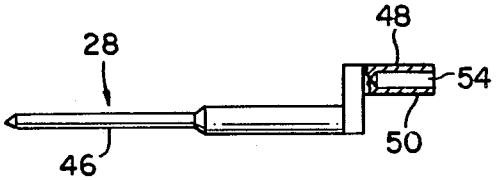
FIG. 10 is a longitudinal, partially sectioned view of an inner contact according to the invention.
Figure 12:
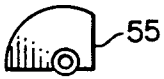
FIG. 12 is a left end view thereof.

With reference to FIGS. 10, 11 and 12, inner contact 28 has a mating end 46 and a termination end 48. The termination end has a flat 50 which aligns with flat area 49 of insulator 30. Inner contact 28 has a deformable bore 54 for receiving the other of the conductors 12 when cable termination occurs. Inner contact 28 has a flat 55 best shown in FIGS. 11, 12 and 17.

Figure 14:
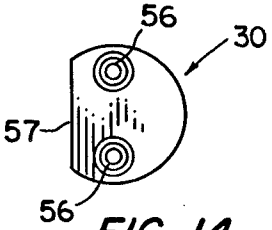
FIG. 14 is a right end view thereof.

With reference to FIGS. 13, 14 and 15, insulator 30 has a pair of apertures 56 which are generally cone shaped (FIG. 13) for simultaneously directing the one and the other conductors 12 into bores 38 and 54 of intermediate and inner contacts 24 and 28, respectively. Insulator 30 has a flat 57 best shown in FIGS. 14 and 17.

Flats 41, 47, 55 and 57 provide location surfaces for the described crimp termination, and are hence an important feature of the invention.

Figure 16:
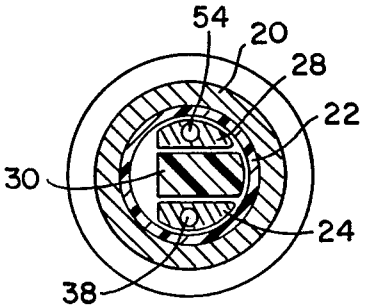
FIG. 16 is a sectioned view taken along line 16—16 in FIG. 1.

FIG. 16 is a sectional view taken along line 16—16 in FIG. 1 and particularly showing the aforementioned concentric relation of the several components of the invention described in detail with reference to FIGS. 4–15.

Figures 17, 18, 19:
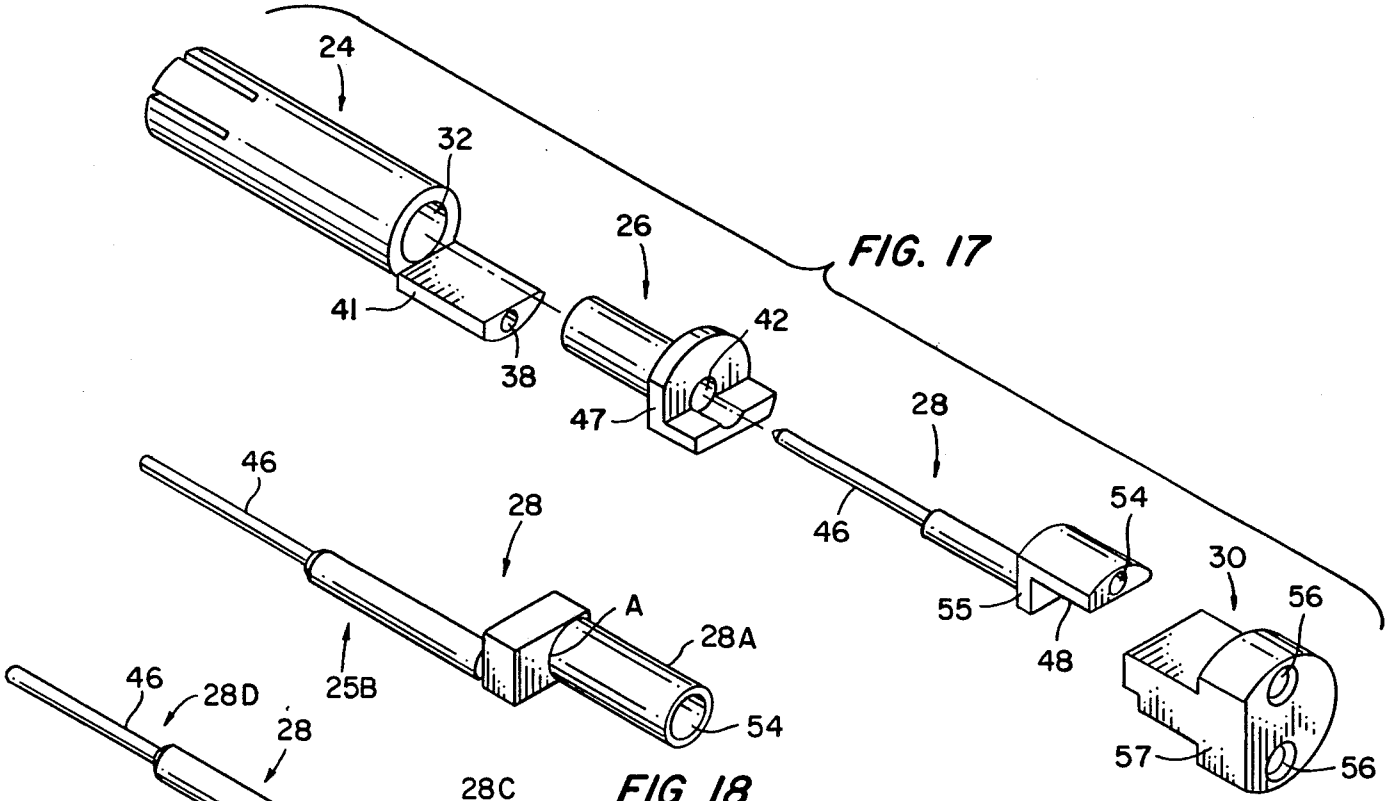
FIG. 17 is an exploded isometric representation of the intermediate/inner contact assembly of the invention.
FIG. 18 is an isometric representation illustrating another embodiment of the inner contact shown in FIG. 10.
FIG. 19 is an isometric representation illustrating yet another embodiment of the inner contact shown in FIG. 10.

FIG. 17 is an exploded view showing the assembly relationship of said several components and further showing flats 41, 47, 55 and 57 for enhancing crimping as aforenoted.

To accomplish termination of the above described contact to cable 6, intermediate/inner contact assembly 16, including intermediate contact 24 and inner contact 28, receives the one and the other conductors 12 which are piloted through apertures 56 of insulator 30, and therefrom simultaneously into bores 38 and 54 of intermediate contact 24 and inner contact 28, respectively, as shown in FIG. 3. A tool or the like 58 is used to simultaneously deform or crimp bores 38 and 54 to retain and electrically join or terminate conductors 12 to the contact. Insulator 30 is of a rigid material as aforenoted and acts as a rigid backing so that the described crimp termination can be accomplished. Following termination of conductors 12 as described, shield 10 is crimped to the outer contact to complete the contact assembly as shown in FIGS. 1 and 2.

In one embodiment of the invention, as shown in FIGS. 10 and 17, inner contact 28 is a machined component.

In another embodiment of the invention as shown in FIG. 18, inner contact 28 includes a member 28A having bore 54 therein and a member 28B having mating end 46 formed thereon. Members 28A and 28B are brazed together as at A to provide the inner contact.

In yet another embodiment of the invention as shown in FIG. 19, inner contact 28 is formed as a bent machined member having a section 28C carrying bore 54 and a section 28D carrying mating end 46.

It will be understood that the several embodiments of inner contact 28 will satisfy particular assembly and/or manufacturing requirements, as the case may be.

With the above description of the invention in mind, reference is made to the claims appended hereto for a definition of the scope of the invention.

What is claimed is:

1. A contact arranged for termination to a twinaxial cable, comprising:

outer contact means;

intermediate/inner contact means disposed with the outer contact means;

the intermediate/inner contact means including first means for receiving first and second conductors of the twinaxial cable and for directing said conductors; second means for receiving one of the first and second conductors directed by the first means, and third means for receiving the other of the first and second conductors directed by the first means; and the second and third means being simultaneously deformable, whereby upon deformation thereof the first and second conductors are retained by the second and third means for terminating the contact to the cable, wherein the third means includes:

an intermediate contact and fourth means concentrically arranged with the intermediate contact and affixed thereto;

the second means concentrically arranged with the fourth means and affixed thereto; and the first means concentrically arranged with the second means and affixed thereto;

and wherein the intermediate contact, and the first, second and fourth means have substantially flat sections in cooperative relation for providing location surfaces for the deformation of the second and third means.

2. A contact as described by claim 1, wherein: the first means is a dielectric insulator; the second means is an inner contact; and the fourth means is a dielectric insulator.

3. A contact as described by claim 1, wherein:

the intermediate contact has an axial bore;

the fourth means includes a section concentrically disposed within the axial bore of the intermediate contact and has an axial bore;

the second means includes a termination end concentrically disposed within the axial bore of the fourth means and a mating end; and the third means has a mating end which extends to the mating end of the second means.

4. A contact as described by claim 1, wherein:

the fourth means is adhesively bonded to the inner contact so as to be affixed thereto;

the second means is adhesively bonded to the fourth means so as to be affixed thereto; and the first means is adhesively bonded to the second means so as to be affixed thereto.

5. A contact as described by claim 1, wherein:

the second means is a single integral member including the termination end and the mating end.

6. A contact as described by claim 1, wherein:

the second means includes a first member including the termination end and a second member including the mating end; and the first and second members are affixed one to the other.

7. A contact as described by claim 1 wherein the intermediate contact includes:

a bore for receiving the other of the first and second conductors directed by a respective other of the first and second apertures; and said other conductor being retained in the bore of the intermediate contact upon deformation of the third means, whereupon said bore is deformed.

8. A contact as described by claim 7, wherein;

the first means is of a rigid material so as to provide a rigid backing for the deformation of the second and third means.

9. A contact as described by claim 1, wherein the outer contact means includes:

an outer contact; and a dielectric insulator concentrically disposed therein and affixed thereto.

10. A contact as described by claim 9, wherein:

the dielectric insulator concentrically disposed in the outer contact is adhesively bonded therein so as to be affixed thereto.

* * * * *